US012075913B2

(12) United States Patent
Williams

(10) Patent No.: US 12,075,913 B2
(45) Date of Patent: Sep. 3, 2024

(54) SOFA BED

(71) Applicant: CWDS, LLC, Lincolnshire, IL (US)

(72) Inventor: Earl Williams, Edwardsburg, MI (US)

(73) Assignee: LIPPERT COMPONENTS MANUFACTURING, INC., Elkhart, IN (US)

( * ) Notice: Subject to any disclaimer, the term of this patent is extended or adjusted under 35 U.S.C. 154(b) by 120 days.

(21) Appl. No.: 17/226,723

(22) Filed: Apr. 9, 2021

(65) Prior Publication Data

US 2021/0315387 A1 Oct. 14, 2021

Related U.S. Application Data

(60) Provisional application No. 63/009,259, filed on Apr. 13, 2020.

(51) Int. Cl.
*A47C 17/17* (2006.01)
*A47C 17/22* (2006.01)

(52) U.S. Cl.
CPC ..... *A47C 17/225* (2013.01)

(58) Field of Classification Search
CPC ... A47C 17/17; A47C 17/175; A47C 17/1753; A47C 17/2073; A47C 17/225; A47C 17/213
See application file for complete search history.

(56) References Cited

U.S. PATENT DOCUMENTS 1,290,152 A 1/1919 Fichtenbaum
1,519,674 A 12/1924 Dyke
(Continued)

FOREIGN PATENT DOCUMENTS

CN 305387554 10/2019
CN 305488936 12/2019
(Continued)

OTHER PUBLICATIONS

International Search Report and Written Opinion for PCT/US21/26635 mailed Aug. 18, 2021.
(Continued)

*Primary Examiner* — Justin C Mikowski
*Assistant Examiner* — Ifeolu A Adeboyejo
(74) *Attorney, Agent, or Firm* — NIXON & VANDERHYE P.C.

(57) ABSTRACT

A sofa that transitions between a sitting position and a sleeping position. The sofa includes a frame with a bracket and multiple arms and support bases that allow the frame to move from the sitting position and the sleeping position, and the reverse, by allowing the multiple arms to rotate and support bases to rotate about the bracket at attachment points where the bracket and arms are connected by fasteners. In some embodiments, a back support portion of the sofa is hingedly moveable into first and second positions to optionally reduce the vertical height of the back support to allow easier transport (i.e., in boxes and shipping containers) and movement (i.e., through small doorways and spaces) of the sofa, as described herein. In some embodiments the sofa has a space or notch underneath that is configured to be fastened or otherwise affixed to a platform, such as a bump out in a recreational vehicle, wherein the notch is configured to provide the sofa with a lower profile.

20 Claims, 13 Drawing Sheets

(56) References Cited

U.S. PATENT DOCUMENTS

| | | | | | |
|---|---|---|---|---|---|
| 1,743,216 | A * | 1/1930 | Honsinger | A47C 17/22 | 5/56 |
| 1,747,150 | A * | 2/1930 | Fox | A47C 17/22 | 5/22 |
| 1,764,874 | A * | 6/1930 | Hultgren | A47C 17/22 | 5/56 |
| 1,764,875 | A * | 6/1930 | Hultgren | A47C 17/22 | 5/56 |
| 1,775,672 | A * | 9/1930 | Duvall | A47C 17/22 | 5/56 |
| 1,806,259 | A * | 5/1931 | Hultgren | A47C 17/22 | 5/56 |
| 1,809,812 | A * | 6/1931 | Fox | A47C 17/22 | 5/56 |
| 1,852,185 | A * | 4/1932 | Moeller | A47C 17/22 | 5/59.1 |
| 1,854,841 | A * | 4/1932 | Hultgren | A47C 17/22 | 5/56 |
| 2,851,698 | A | 9/1958 | Barabas et al. | | |
| 3,317,930 | A * | 5/1967 | Wiberg | A47C 17/17 | 5/45 |
| 3,389,409 | A * | 6/1968 | Rogers, Jr. | A47C 17/134 | 5/28 |
| 3,456,268 | A * | 7/1969 | Rogers, Jr. | A47C 17/22 | 5/28 |
| 3,906,558 | A * | 9/1975 | Alembik | A47C 17/22 | 297/118 |
| 4,212,090 | A | 7/1980 | Ehrlich | | |
| 4,590,630 | A | 5/1986 | Barabas | | |
| 4,672,696 | A * | 6/1987 | Horenkamp | A47C 17/134 | 5/20 |
| 4,860,393 | A | 8/1989 | Schefthaler | | |
| 4,866,795 | A | 9/1989 | Dahlqvist | | |
| 4,922,561 | A | 5/1990 | Williams | | |
| 4,985,945 | A | 1/1991 | Robinson | | |
| 5,722,101 | A | 3/1998 | Grigoriev | | |
| 5,904,401 | A | 5/1999 | Alberda et al. | | |
| 6,341,392 | B1 | 1/2002 | Maekinen | | |
| 6,904,628 | B2 | 6/2005 | Murphy et al. | | |
| 7,827,629 | B1 | 11/2010 | Guillot | | |
| 8,011,034 | B2 | 9/2011 | Hoffman et al. | | |
| 8,438,676 | B2 * | 5/2013 | Murphy | A47C 3/16 | 5/28 |
| 8,893,323 | B2 | 11/2014 | Garland | | |
| 8,997,273 | B2 | 4/2015 | Murphy et al. | | |
| 9,144,319 | B2 | 9/2015 | Murphy et al. | | |
| 9,173,502 | B2 | 11/2015 | Smith et al. | | |
| 9,414,688 | B2 | 8/2016 | Gardner | | |
| 9,420,894 | B2 | 8/2016 | Thurow | | |
| 9,622,587 | B2 * | 4/2017 | Murphy | A47C 7/402 | |
| 9,642,468 | B2 | 5/2017 | Murphy et al. | | |
| 9,854,916 | B2 | 1/2018 | Murphy | | |
| 9,895,002 | B1 | 2/2018 | Cooke et al. | | |
| 10,226,131 | B2 | 3/2019 | Thurow | | |
| 10,556,524 | B1 | 2/2020 | Slater | | |
| 2003/0070225 | A1 * | 4/2003 | Murphy | A47C 17/2076 | 5/13 |
| 2016/0051057 | A1 * | 2/2016 | Murphy | A47C 17/2073 | 5/29 |
| 2018/0064258 | A1 * | 3/2018 | Murphy | A47C 17/138 | |
| 2018/0116410 | A1 | 5/2018 | Ritter et al. | | |
| 2019/0110604 | A1 | 4/2019 | Garland | | |

FOREIGN PATENT DOCUMENTS

| | | | | |
|---|---|---|---|---|
| CN | 305513406 | | 12/2019 | |
| DE | 19521139 | A1 * | 1/1996 | A47C 17/213 |
| EP | 1464256 | | 10/2004 | |
| EP | 2850973 | | 3/2015 | |
| EP | 2875754 | | 5/2015 | |

OTHER PUBLICATIONS

Luonto Furniture, Leon Queen size sleeper HD, https://www.youtube.com/watch?v=VHRBwK1gxOc created Nov. 11, 2016.

International Preliminary Report on Patentability mailed Mar. 30, 2022 from the International Preliminary Examining Authority for PCT/US2021/026635.

European Search Report dated May 22, 2024 issued in European Patent Application No. 21789119, 1 page.

* cited by examiner

SOFA BED

FIELD OF THE INVENTION

The present invention relates to convertible furniture. More specifically, it relates to sofas that convert between sitting and sleeping configurations.

BACKGROUND OF THE INVENTION

Sofas are commonly sold as sitting furniture that allow more people to comfortably sit side-by-side as compared to other furniture, such as an individual chair. Sofas range in size from small two-person love seats to large couches that can hold four or more people. Some sofas include mechanisms that allow the seat portion to unfold outward and forward to convert into a bed. This combination is commonly called a "sleeper sofa", "stowaway sofa", or "sofa bed".

Sleeper sofas provide the convenience of a dual-purpose piece of furniture, but they can be hard to manage due to the weight of the bed frame and mattress stored within the seat of the sofa. A shortcoming of existing sleeper sofas is that they have a frame that is segmented into three segments that fold up. This means that the bottom of an uppermost segment that supports the sofa seat in the sitting position is inverted when the sofa is in the bed position. Thus, the horizontal seat cushions must be removed from the uppermost segment before the sleeper sofa can be converted from a sofa to a bed. Another shortcoming is that the bed length is defined by approximately a triple depth of the seat, making it difficult for the sleeper sofa to be used where space is limited, such as in recreational vehicles or airplanes (i.e., as first class sets on long-haul flights).

What is needed is a sleeper sofa that is configured to be deployed without inverting any of its segments so that the seat cushions do not need to be removed before converting the sofa to a bed. What is also needed is a sitting surface with an abbreviated depth for use in small spaces while still providing a sufficiently long sleeping surface after being converted to a bed. Additionally, there is a need in the art for a sofa having a foldable back to improve shipping capacity and enable movement of the sofa in confined spaces such as recreational vehicles.

SUMMARY OF THE DISCLOSURE

The present invention is an apparatus for use as a convertible sleeping and sitting surface. Specifically, the apparatus is a sleeper sofa for use in relatively confined spaces, such as a recreational vehicle.

One embodiment of the present disclosure is an apparatus for sitting and sleeping that includes: 1) a frame having a rear section that is floatable along at least one hinge and/or 2) a rear cushion that is foldable along at least one hinge and/or slideable along a slideway. The frame may include: a pair of brackets; a pair of front arms; a pair of back arms; a front horizontal base connected to the pair of front arms and the pair of back arms, wherein the front arms are on opposite sides of the front horizontal base, and wherein the back arms are on opposite sides of the front horizontal base; a middle horizontal base connected to the pair of front arms and the pair of back arms, wherein the front arms are on opposite sides of the middle horizontal base, and wherein the back arms are on opposite sides of the middle horizontal base; a back horizontal base; a pair of rear back horizontal base arms connected to opposite sides of the back horizontal base; a pair of forward back horizontal base arms connected to opposite sides of the back horizontal base; wherein, each of the front arms, the back arms, the rear back horizontal base arms, and the front back horizontal base arms are connected to one of the brackets with one or more fasteners; and wherein the brackets are configured such that the back horizontal base, the middle horizontal base, and the front horizontal base can transition between a sitting position and the sleeping position without changing their (upwardly facing) orientation relative to gravity.

In some embodiments, one or more cushions may be removeable from the sofa. In some embodiments, a back support portion of the sofa is hingedly moveable in first and second positions to optionally reduce the vertical height of the sofa to allow easier transport (i.e., in boxes and shipping containers) and movement (i.e., through small doorways and spaces) of the sofa, as described herein. In some embodiments the sofa has a space or notch formed by the frame and a pair of support legs that is configured to be fastened or otherwise affixed to a platform, wherein the platform is moveable such as in a recreational vehicle. The space or notch serves to allow the seat and bed height of the sofa to remain lower than what it might otherwise be if the sofa were mounted on its legs on the platform.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE DISCLOSURE

Figure 1A:
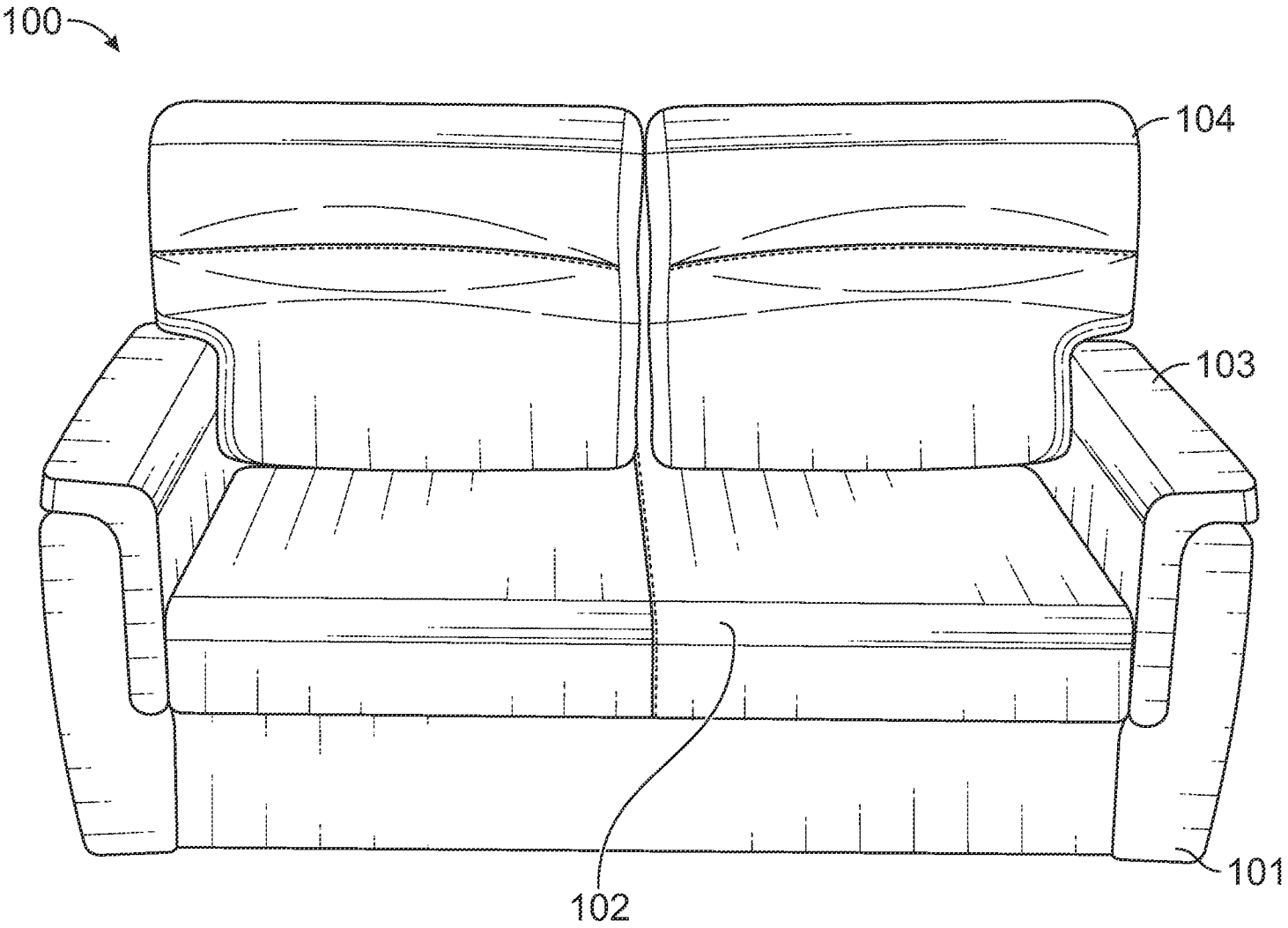
FIG. 1A is a picture of the sleeper sofa in a sitting configuration according to one embodiment of the present disclosure.

While this invention may be susceptible to embodiment in different forms, specific embodiments are shown in the drawings and will be described herein in detail with the understanding that the present disclosure is to be considered an exemplification of the principles of the invention and is not intended to limit the invention to that as illustrated.

FIGS. 1A-1D show different views of one embodiment of an apparatus 100 for a sofa that is convertible into a sleeping surface. FIG. 1A shows a diagram of the apparatus 100 with a pair of outer arms 101 that define a seating space, a slide-out assembly 102 that is disposed within the seating space, a pair of inner arms 103 disposed on top of the pair of outer arms 101, and an optional set of upright cushions 104 at the back of the seating space. The slide-out assembly 102 is configured to transition between a sitting configuration, shown in FIG. 1A, and a sleeping configuration, shown in FIG. 1C. The slide-out assembly 102 is made of suitable materials to support the weight of several people in either configuration, typically metal with a cloth and padding covering.

Figure 1B:
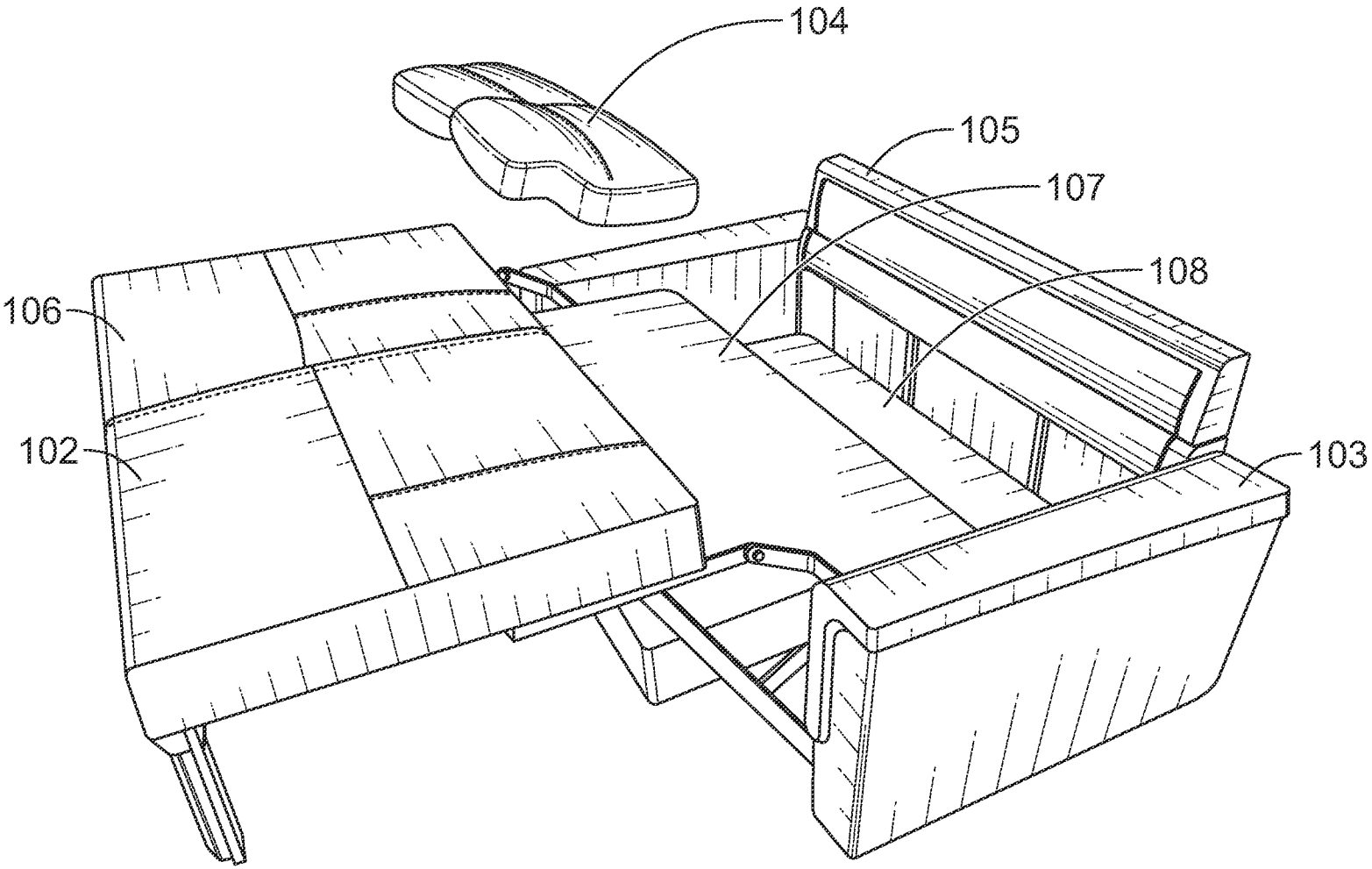
FIG. 1B is a picture of the apparatus of FIG. 1A partially converted between the sitting and sleeping configurations.

FIG. 1B shows a diagram of the apparatus 100 with the slide-out assembly 102 partially deployed. The upright cushions 104 have been removed and set to the side to reveal the upright back support 105 that is disposed between the inner arms 103. As shown, the slide out assembly 102 preferably includes three horizontal sections: a front horizontal cushion or slab 106, a middle horizontal cushion or slab 107, and a back horizontal cushion or slab 108. The cushions may be made of any suitable material for providing comfort while supporting the weight of occupants, as would be understood by a person of skill in the art.

Figure 1C:
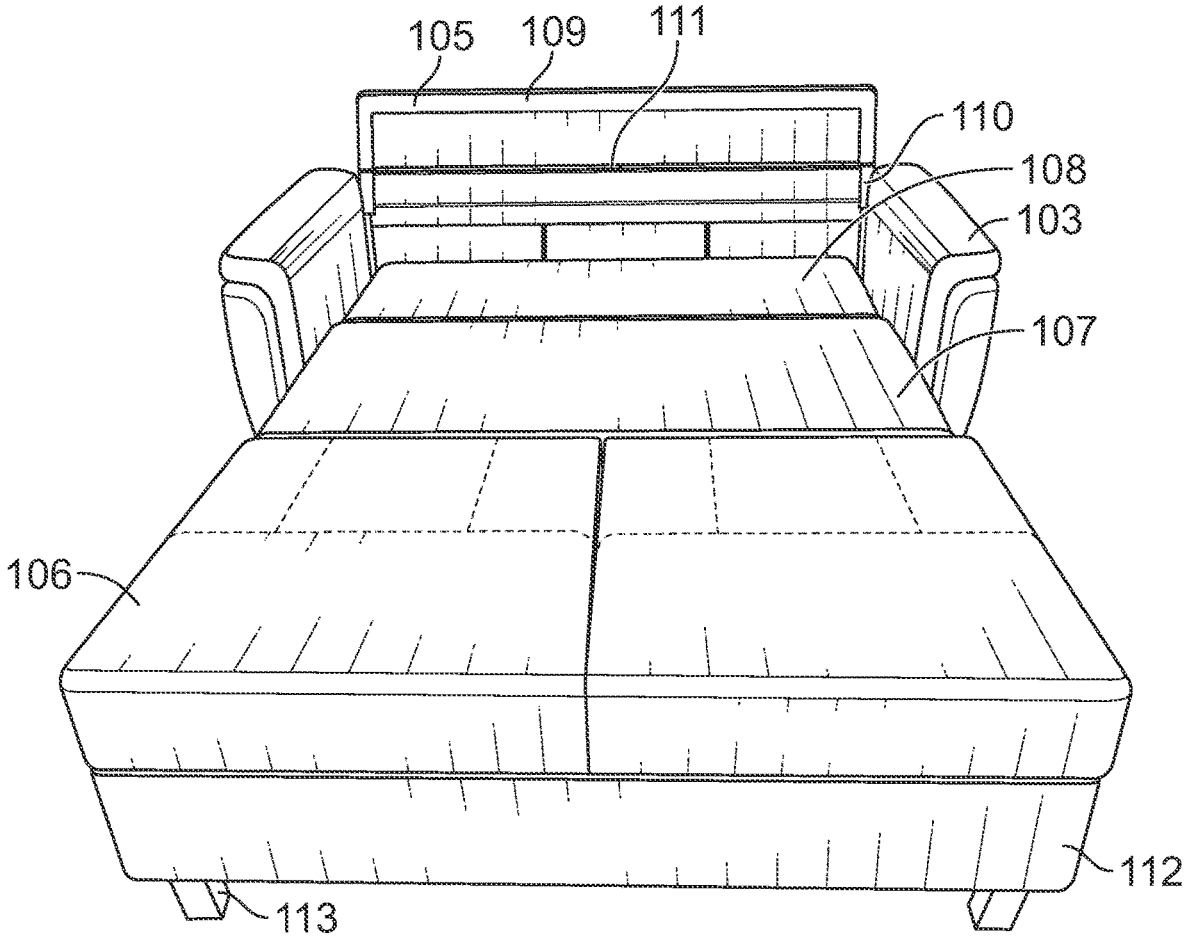
FIG. 1C is a picture of the apparatus of FIG. 1A in the sleeping configuration.
Figure 1D:
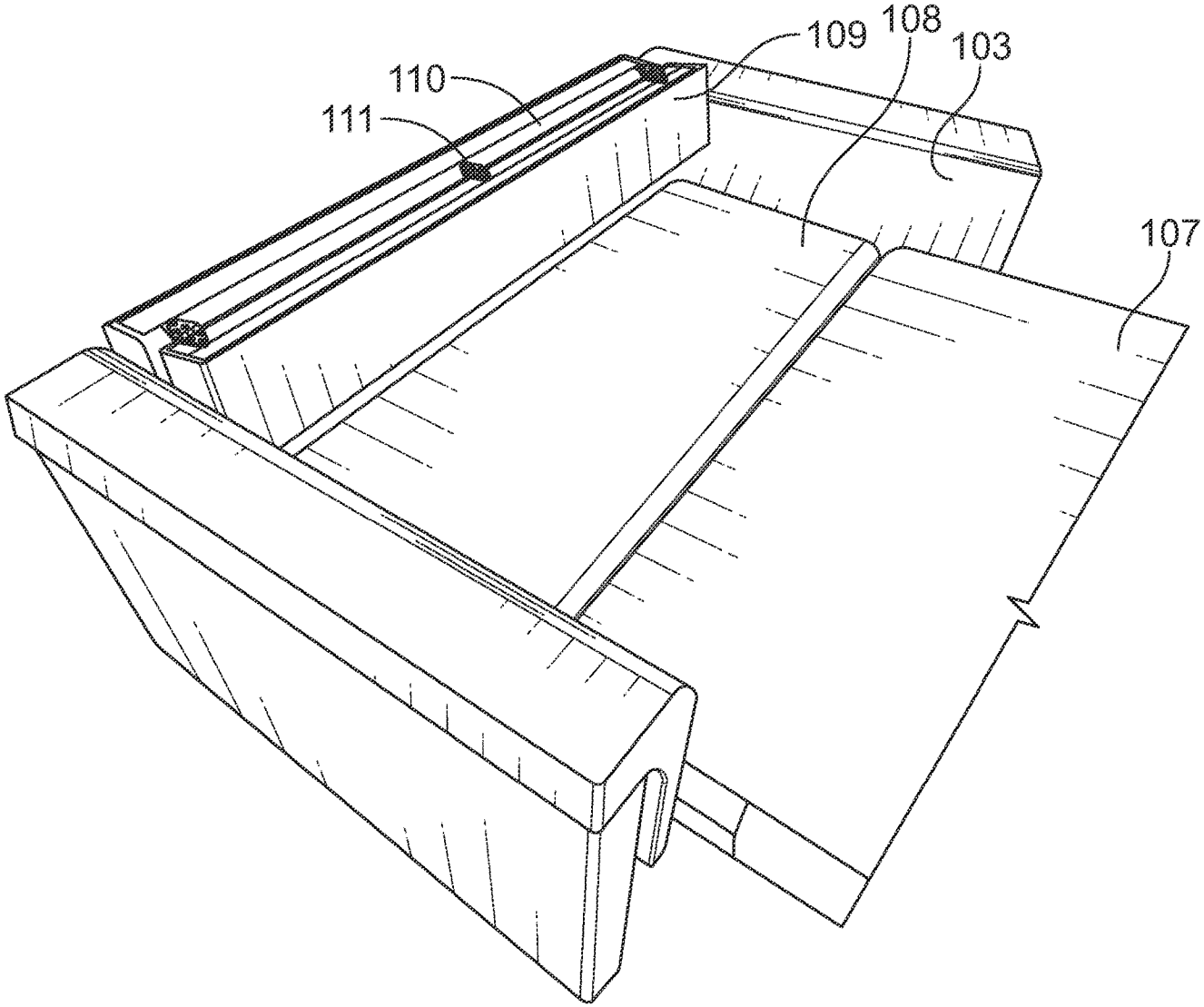
FIG. 1D is a picture of the apparatus of FIG. 1A in the sleeping configuration with the back rest folded down.

FIG. 1C shows a diagram of the apparatus 100 in the sleeping position, where the slide-out assembly 102 is fully deployed. The front of the apparatus 100 may include a skirt 112 and legs 113 at the front and sides to cover front of the slide-out assembly 102 when in both the sitting configuration and the sleeping configuration. As shown in FIGS. 1C and 1D, preferably the upright back support 105 is configured to fold down. To that end, the upright back support 105 may include a top portion 109 and bottom portion 110 that are connected by one or more hinges 111 or similar device configured to allow the upright back support 105 to diminish in height as desired. Alternatives may include a top portion 109 being removable. As can be seen, the slide-out assembly 102 has been fully deployed without any of cushions or slabs 106, 107, 108 being moved relative to the slide-out assembly 102. The upright cushions 104 may, optionally, be used as pillows or other soft support.

FIG. 1D shows a diagram of the apparatus 100 with the upright back support 105 in the folded down position. Specifically, the top portion 109 has been rotated forward in front of the lower portion 110 by pivoting the top portion 109 along the hinge(s) 111.

FIGS. 2A-2E provides a series of side-view diagrams of the slide-out assembly 102 in the various positions, transitioning from the sitting configuration to the sleeping configuration. Each side of the slide-out assembly 102 has corresponding parts and a frame (not shown) between the two sides including necessary supports, springs, and fasteners for providing structural integrity to the apparatus 100. Preferably, the slide-out assembly 102 includes a bracket 201, a back arm 202, a front arm 203, a plurality of fasteners 204 for the arms 202, 203, a plurality of fasteners 205 for the bracket 201, a front horizontal base 206, a middle horizontal base 207, a back horizontal base 208, a rear back horizontal base arm 209, and a forward back horizontal base arm 210. The apparatus 100 includes underlying frame elements (not shown) that connect the sides of the slide-out assembly 102. The apparatus 100 may also include underlying comfort features, such as support springs (known to those of skill in the art), that are attached to the frame.

Figure 2A:
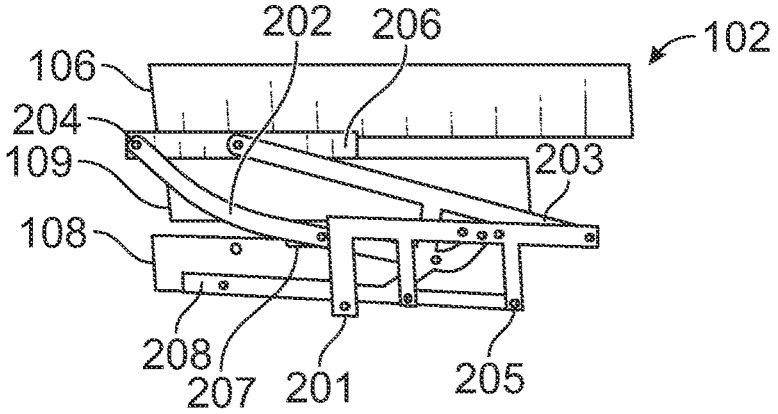
FIG. 2A is a diagram of the side view of one embodiment of the slide-out assembly of the apparatus of FIG. 1A in the sitting configuration according to the present disclosure.

FIG. 2A shows a diagram of a side view of the slide-out assembly 102 in a sitting position. As shown, the bracket 201 is attached to the each of the rear arm 202, the front arm 203, the rear back horizontal base arm 209 and the forward back horizontal base arm 210. Back horizontal base 208 is connected to arms 209, 210. Front horizontal base 206 is connected to the rear arm 202 and the front arm 203. Middle horizontal base 207 is also connected to the rear arm 202 and the front arm 203, through as different positions than the base 206. The attachments of the various parts are performed by the fasteners 204, 205. The bracket 201 is made of a suitable material to support the connections and the intended weight of occupants of the apparatus 100. The front horizontal base 206 is configured and dimensioned to support the front cushion 106. The middle horizontal base 207 is configured and dimensioned to support the middle cushion 107. The back horizontal base 208 is configured and dimensioned to support the back cushion 108. The cushions 106, 107, 108 may be removable or permanently fastened or otherwise fixed to the bases 206, 207, 208. The fasteners 204, 205 may be any fastener of suitable strength known to a person of skill in the art, including, but not limited to, bolts, rivets, screws, dowels, and/or the like. Attachment points are provided in the bracket 201 for insertion of the fasteners 204, 205 and positioning of the arms 202, 203, 209, 210.

Figure 2B:
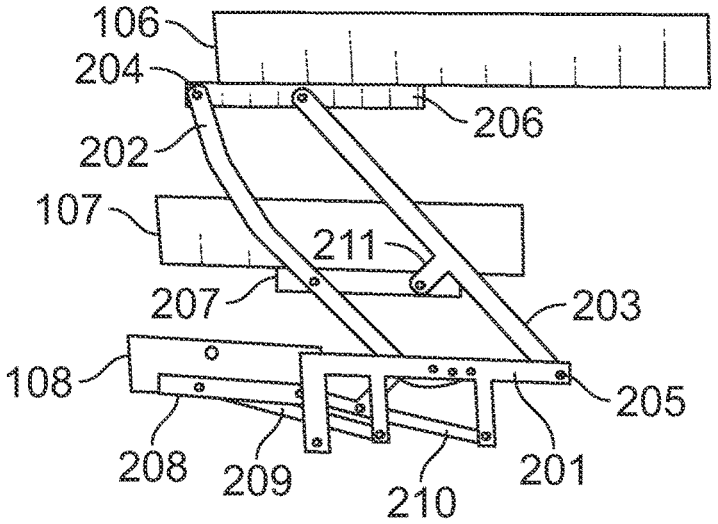
FIG. 2B is a diagram of the side view of one embodiment of the slide-out assembly of the apparatus of FIG. 1A transitioning upward out of the sitting configuration according to the present disclosure.

FIG. 2B shows a diagram of a side view of the slide-out assembly 102 deploying upward to transition from the sitting position to the sleeping position. The arms 202, 203 rotate relative to the bases 206, 207, 208 at their fasteners 204 and rotate about the bracket 201 on their fasteners 205. The rear arm 202 is configured to apply force to the forward back horizontal base arm 210, and the rear back horizontal base arm 209 via one or more branches 220 connected at one end to the arms 202, 203 and at the other end to arms 209, 210. As shown, the front arm 203 includes one or more optional stubs 211 that can act as an attachment point for the middle horizontal base 207. Alternatively, the middle horizontal base 207 may be directly attached to the front arm 203. The rear arm 202 and the front arm 203 move the bases 206, 207 upwardly, outwardly, and downwardly during deployment in the sleeping position, although the front horizontal base 206 and the middle horizontal base 207 preferably do not rotate away from a horizontal orientation. Similarly, the rear back horizontal base arm 209 and the forward back horizontal base arm 210 move in a manner similar and complementary to the movement of bases 206, 207.

Figure 2C:
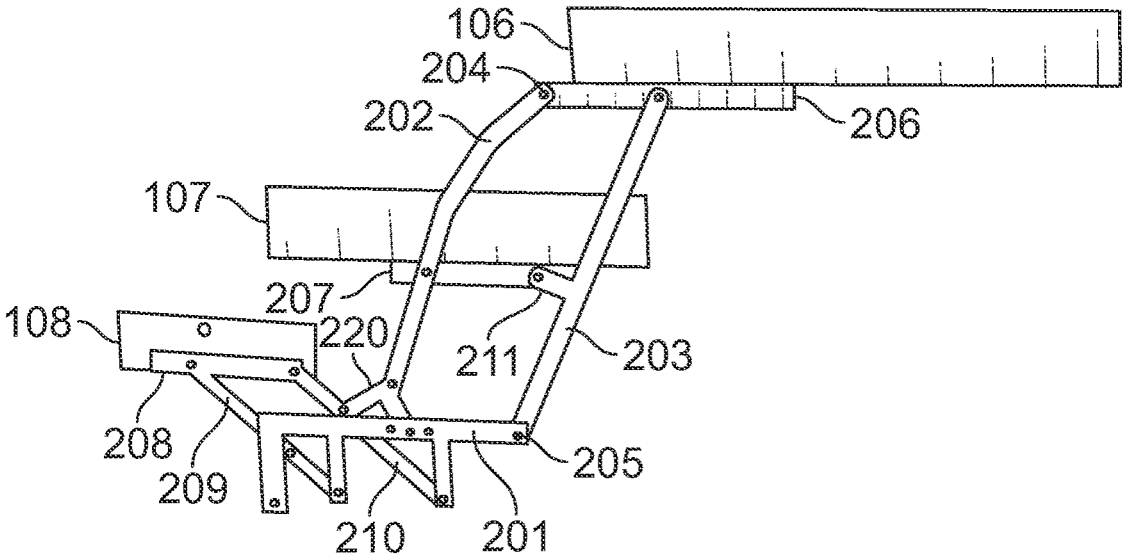
FIG. 2C is a diagram of the side view of one embodiment of the slide-out assembly of the apparatus of FIG. 1A transitioning outward from the sitting configuration according to the present disclosure.

FIG. 2C shows a diagram of a side view of the slide-out assembly 102 moving forward from the upward deployment in FIG. 2B.

Figure 2D:
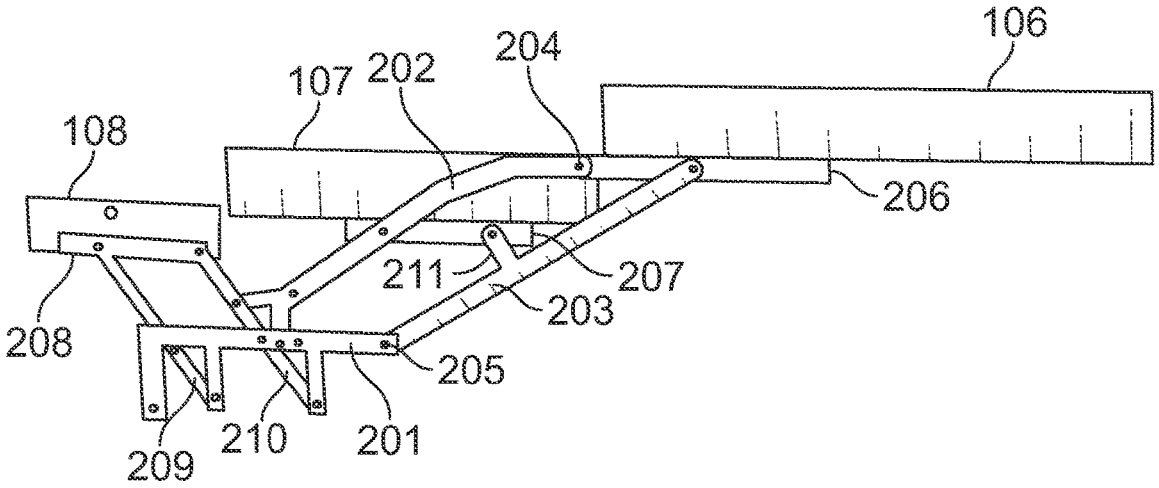
FIG. 2D is a diagram of the side view of one embodiment of the slide-out assembly of the apparatus of FIG. 1A transitioning downward into the sleeping configuration according to the present disclosure.

FIG. 2D shows a diagram of a side view of the slide-out assembly 102 moving downward toward the sleeping position after being fully forward deployed as shown in FIG. 2C. It can be seen that the bases 206, 207, 208 and the cushions or slabs 106, 107, 108 are dimensioned to form a flat sleeping surface, and that the cushions or slabs 106, 107, 108 are dimensioned to move relative to one another without interfering with one another when the apparatus 100 transitions from the sitting position shown in FIG. 2A to the sleeping position shown in FIG. 2E.

Figure 2E:
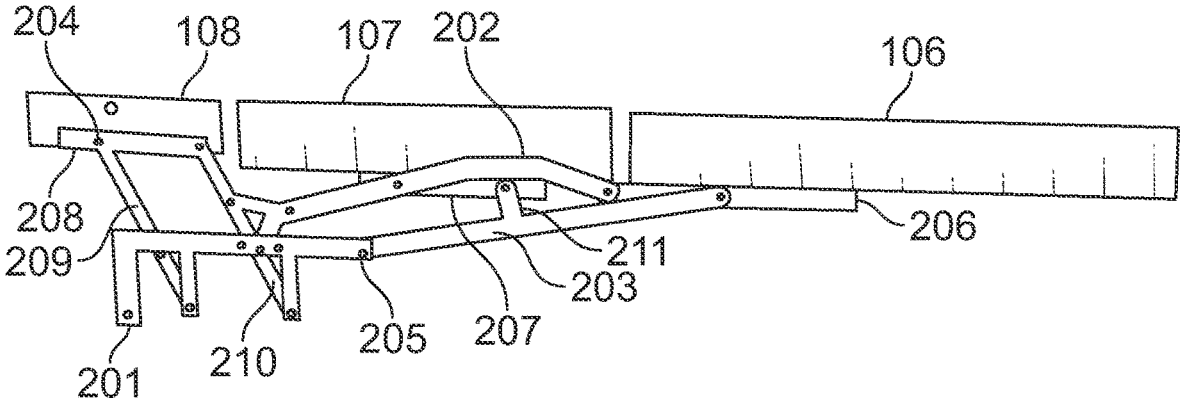
FIG. 2E is a diagram of the side view of one embodiment of the slide-out assembly of the apparatus of FIG. 1A in the sleeping configuration according to the present disclosure.

FIG. 2E shows a diagram of a side view of the slide-out assembly 102 in the sleeping position. As shown, in this position, preferably the cushions or slabs 106, 107, 108 align to form a flat sleeping surface. The depth of the front horizontal cushion or slab 108 may be selected to be deeper than the depths of the middle horizontal cushion or slab 107 and the back horizontal cushion or slab 106, either individually or combined.

In a preferred embodiment, as shown herein, the cushions 106, 107, 108 and corresponding bases 206, 207, 208 are substantially nested within the sofa 100 in the seating orientation. The cushions 106, 107, 108 and the bases 206, 207, 208 are upwardly-facing, and although the cushions and the bases move horizontally and vertically as the sofa transitions from the sitting position (see FIGS. 1A and 2B) to the sleeping position (see FIGS. 1C, 1D and 2E), the cushions 106, 107, 108 and the bases 206, 207, 208 preferably do not rotate and thus remain in an upwardly facing orientation during the entire transition. Alternatively, the apparatus 100 may comprise one or more cushion portions that rotate and/or move from an upwardly facing orientation.

Figure 2F:
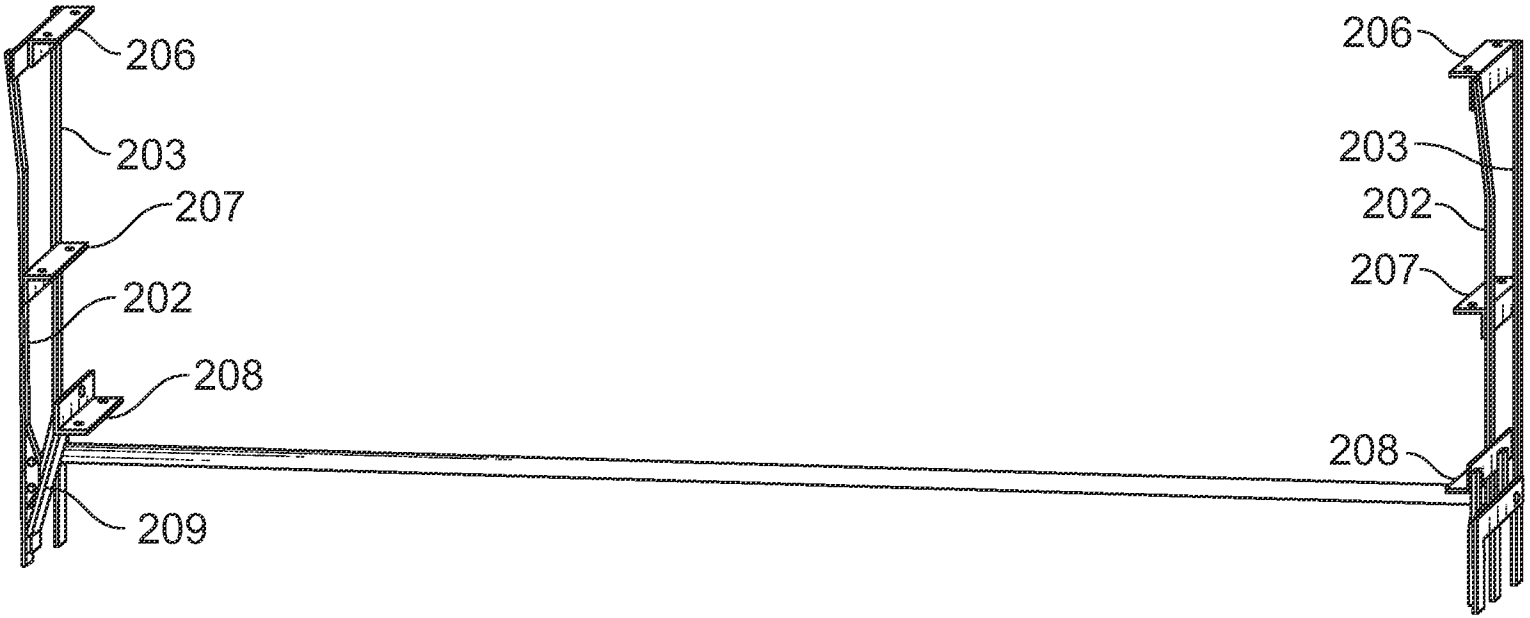
FIG. 2F is a diagram of the 3-D view of one embodiment of the slide-out assembly of the apparatus of FIG. 1A in the transition position shown in FIG. 2B according to the present disclosure.
Figure 3:
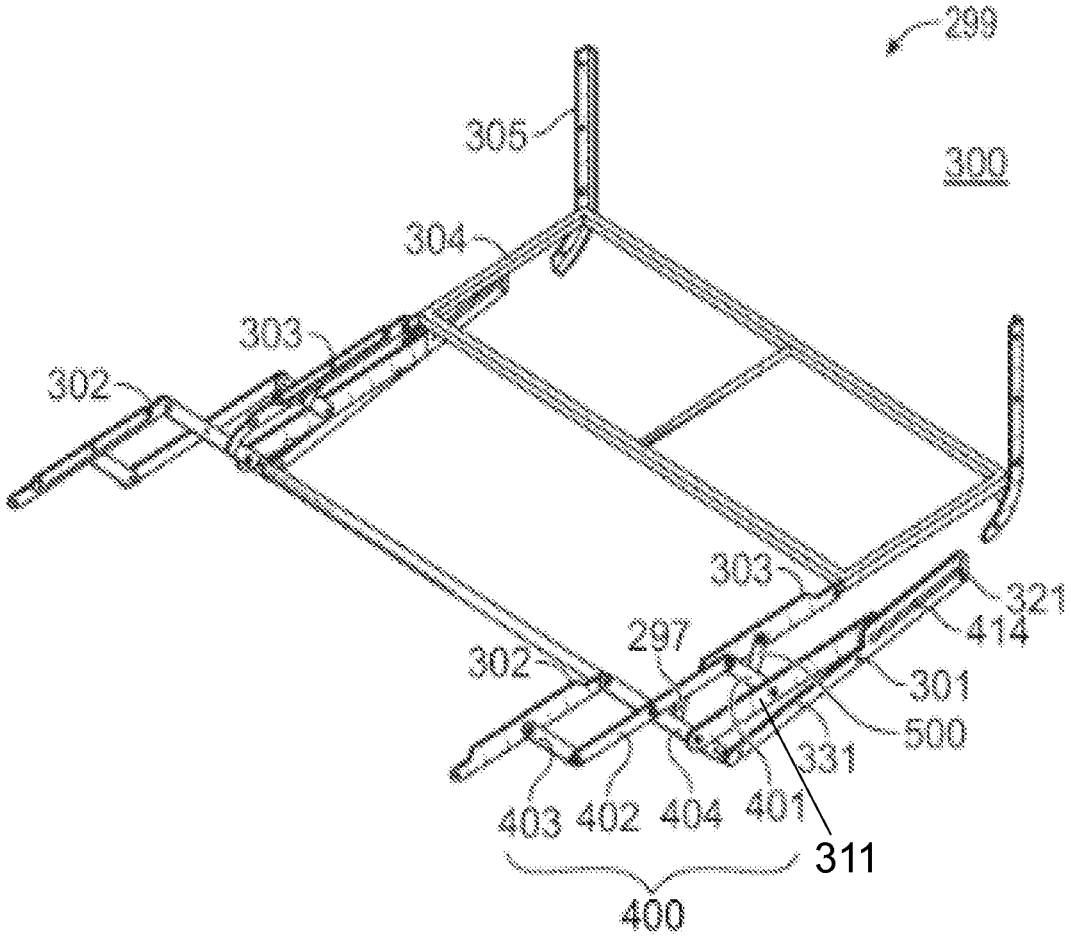
FIG. 3 is a diagram of a frame body structure of an alternative embodiment according to the present disclosure.
Figure 4:
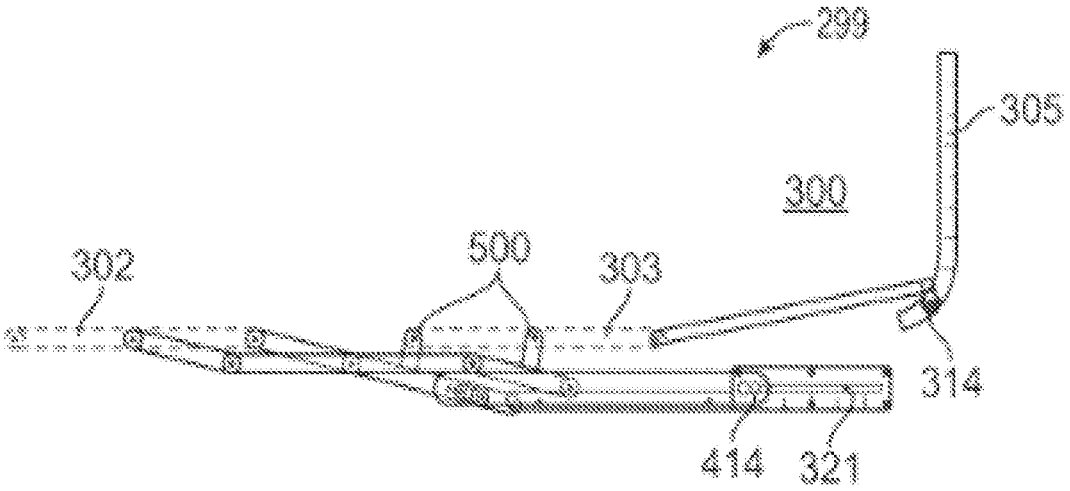
FIG. 4 is a diagram of a side view of the frame body structure of FIG. 3 in an unfolded position.

FIG. 2F shows a diagram of a 3-D view of the slide-out assembly 102 deploying upward in the same position as shown in FIG. 2B.

FIGS. 3-11 show diagrams of an alternative embodiment of the present invention in the form of a foldable frame 299 comprising a frame body 300. The frame body 300 has the same structure on each side, consisting of two chassis 301, two first support rods 302 and two second support rods 303, all of which are appropriately configured. Each chassis 301 is equipped with a base rod 311. The first support rod 302 and second support rod 303 are connected by a connecting structure 400 on each side. The connecting structure 400 consists of a first connecting rod 401, a second connecting rod 402, a third connecting rod 403 and a fourth connecting rod 404.

One end of the first connecting rod 401 is hinged with the second connecting rod 402. The other end of the first connecting rod 401 is hinged with the base rod 311. One end of the second connecting rod 402 is hinged with the first connecting rod 401, while the other end of the second connecting rod 402 is hinged with the third connecting rod 403 and the center of the second connecting rod 402 is hinged with the fourth connecting rod 404. One end of the third connecting rod 403 is hinged with the second connecting rod 402, and the other end of the third connecting rod 403 is hinged with the first support rod 302. One end of the fourth connecting rod 404 is hinged with the chassis 301, and the other end of the fourth connecting rod 404 is hinged with the first support rod 302.

One end of the base rod 311 is hinged onto the fourth connecting rod 404. The other end of the base rod 311 is fitted with a sliding piece 414. The chassis 301 is equipped with a sliding rail 321. The sliding piece 414 can move along the length of the sliding rail 321. The chassis 301 is equipped with an extension 331. The sliding rail 321 is located at the rear end of the extension 331, and the fourth connecting rod 404 is hinged with the front end of the extension 331.

The first connecting rod 401 and fourth connecting rod 404 are fitted with an extension rod 500. The end of the extension rod 500 is hinged with the second support rod 303.

The frame body 300 comprises a support frame 304 and a slideway 305. The ends of the second support rods 303 are hinged with the front end of the support frame 304 on each side. The rear end of the support frame 304 is equipped with rollers 314 that can move along the slideway 305.

The first support rod 302, the second support rod 303, the connecting structure 400 and the base rod 311 form a parallelogram structure on each side.

Figure 5:
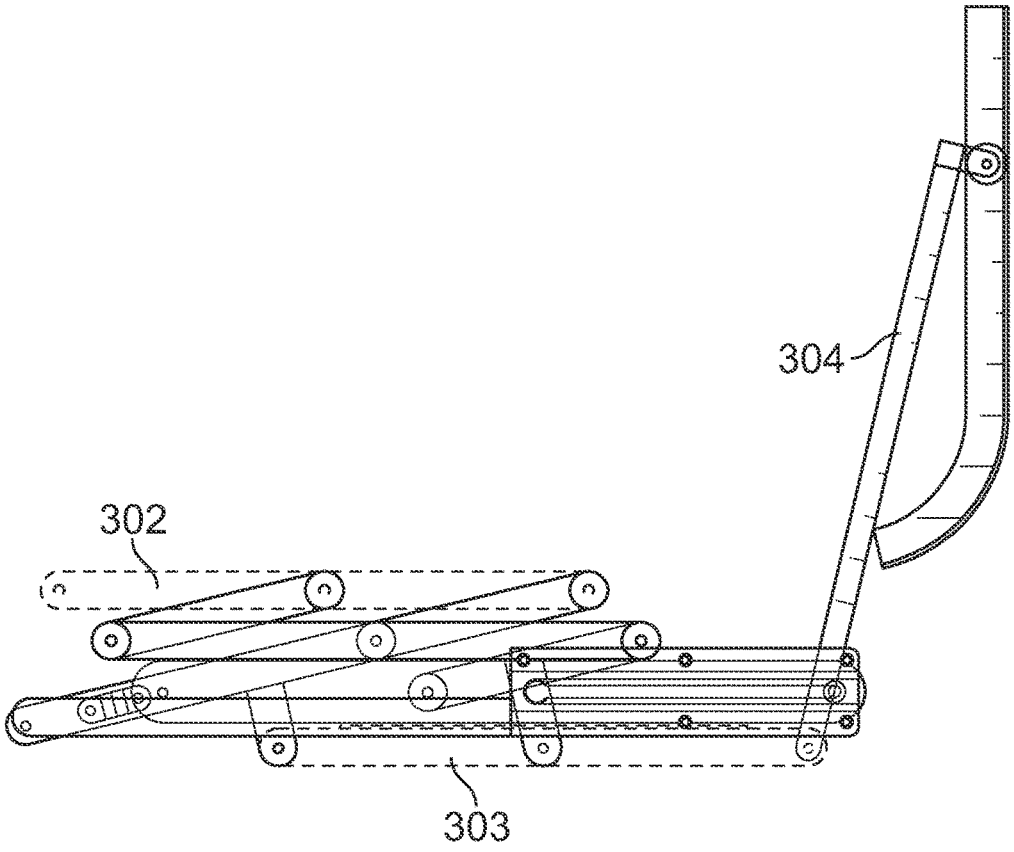
FIG. 5 is a diagram of a side view of the frame body structure of FIG. 3 in a folded position.

When the first support rod 302 is pushed to fold up the frame body 300, the second support rod 303 is positioned underneath the first support rod 302 (see FIG. 5). When the first support rod 302 is pulled to unfold the frame body 300, the second support rod 303 is parallel with the first support rod 302 (see FIG. 4). This allows the frame to be folded and unfolded. When the first support rod 302 is pushed, the sliding piece 414 moves backwards along the sliding rail 321 and the roller 314 moves upwards along the slideway 305. In some embodiments, the slideway 305 may be j-shaped. When the first support rod 302 is pulled, the sliding piece 414 moves forwards along the sliding rail 321 and the roller 314 moves downwards along the slideway 305. As shown, support frame 304 may rest at a slight incline of 0 to 15 degrees and preferably 10 degrees in the bed configuration.

Figure 6:
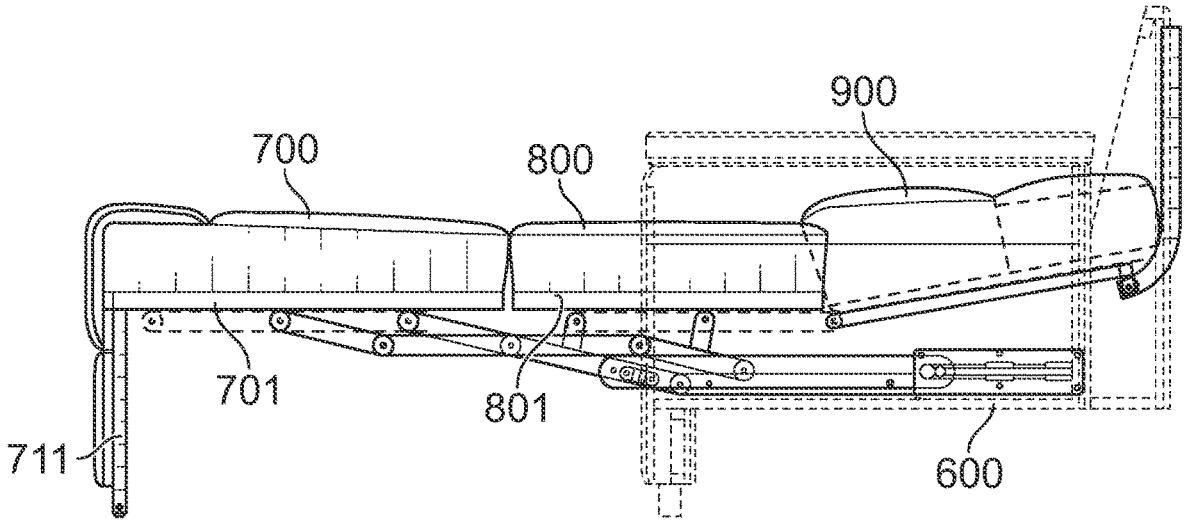
FIG. 6 is a diagram of a side view of the frame body structure of FIG. 3 in an unfolded position with cushions and disposed in a seat frame according to one embodiment of the present disclosure.
Figure 7:
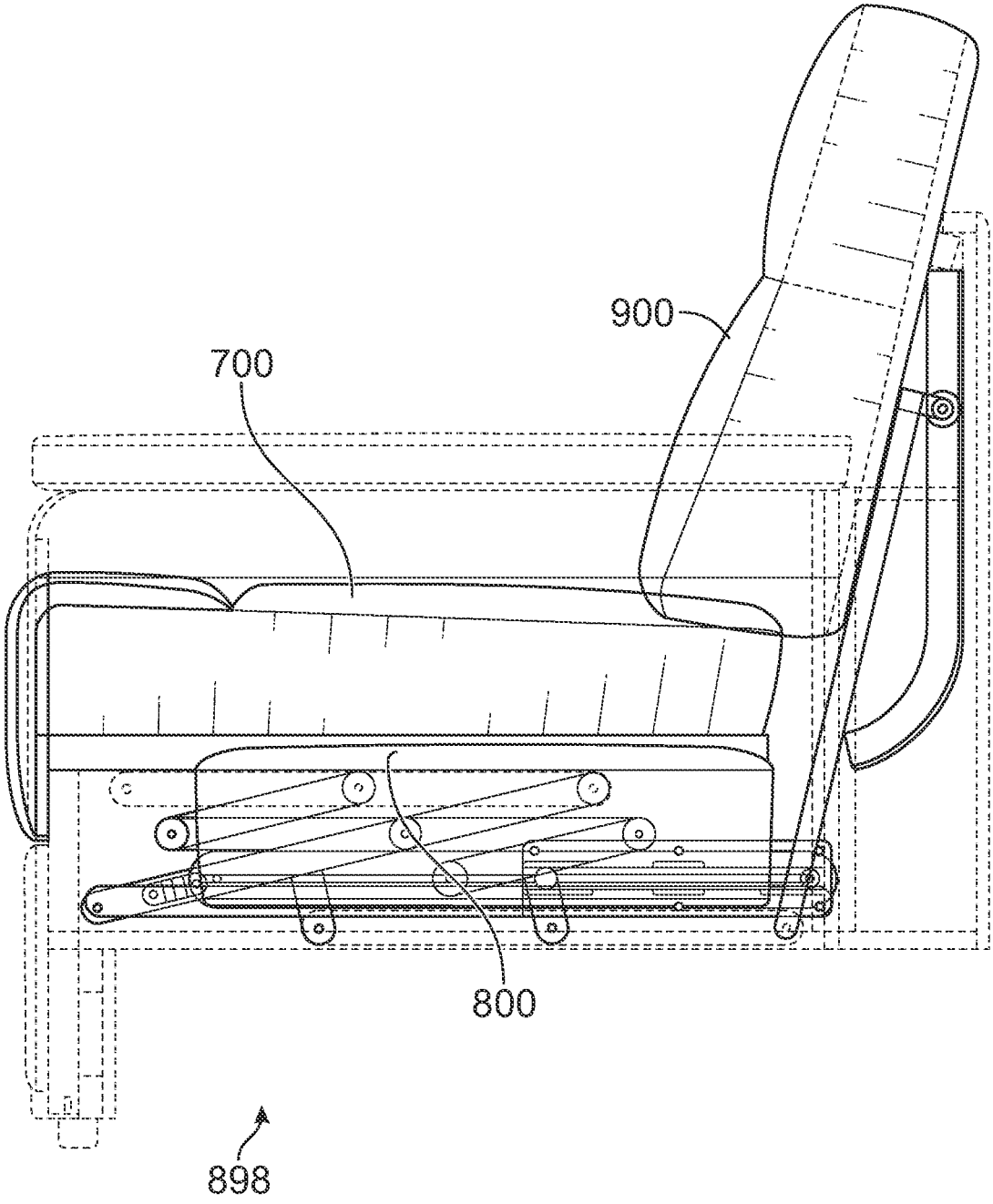
FIG. 7 is a diagram of a side view of the frame body structure of FIG. 3 in a folded position with cushions.

FIG. 6 shows a diagram of a side view of the foldable frame 299 disposed in a seat frame 600. The chassis 301 is secured to the seat frame 600. The slideway 305 is also secured to the seat frame 600. The seat frame 600 may include arms 610 and a back section 620.

The first cushion 700 is positioned above the first support rod 302. The base of the first cushion 700 is connected to the first support plate 701, and the first support plate 701 is connected to the first support rod 302 by a fastener. The first support plate 701 is equipped with a support stand 711 to support the seat on the floor. The second cushion 800 is positioned above the second support rod 303. The base of the second cushion 800 is connected to the second support plate 801, and the second support plate 801 is connected to the second support rod 303 with a fastener. The third cushion 900 is positioned directly on the support frame 304.

When the first support rod 302 is pushed or pulled, the third cushion 900 is preferably removed. The third cushion 900 can then be replaced on the support frame 304 after the frame body 300 has been fully unfolded or folded.

In the first embodiment (FIGS. 1A-2E, the upright back support 105 of the apparatus 100 is configured to effectively fold, specifically along one or more hinges 111. In the second embodiment (FIGS. 3-8), the support frame 304 of the foldable frame 299 is configured to move down along a slideway 305.

Figure 8:
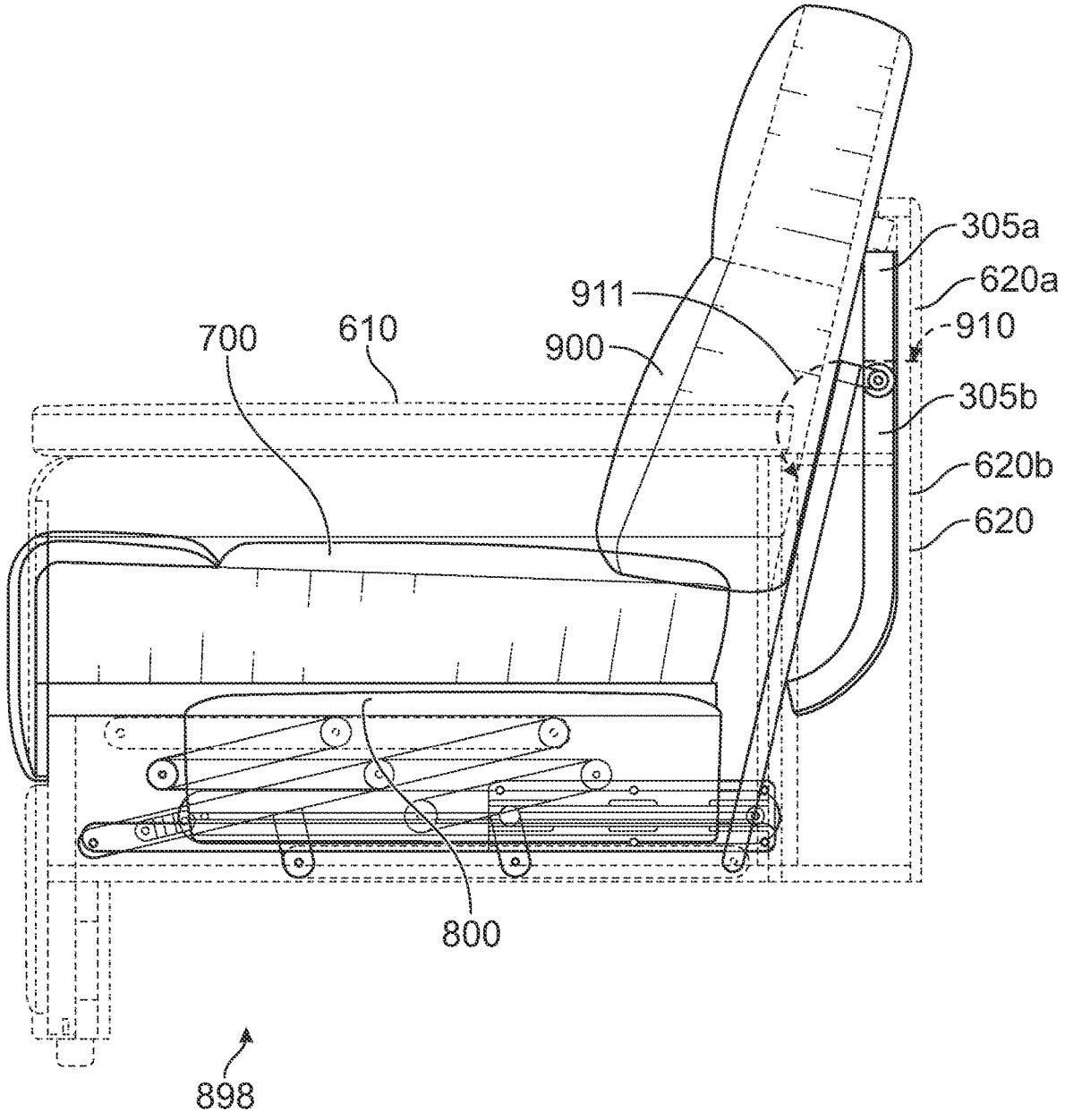
FIG. 8 is a diagram of the side view of the frame body structure of FIG. 7 with a hinge added to allow part of the frame to fold down.

FIG. 8 shows a diagram of a variation of the second embodiment, where the back section 620 is made up of an upper section 620*a* and a lower section 620*b*. Likewise, the slideway 305 is made up of an upper section 305*a* and a lower section 305*b*. The slideway upper section 305*a* and the slideway lower section 305*b* are connected by a hinge 911 that allows the slideway upper section 305*a* to move in the direction 911. The upper section 620*a* is connected to the slideway upper section 305*a* so that both upper sections 620*a*, 305*a* move together when folded in direction 911. The hinge 910 may be conventional and may consist of appropriate hardware, such as two plates pivotably connected together by a pin where each plate is fastened or otherwise affixed to the frame. This allows the vertical profile of the sofas depicted in FIGS. 1-11 to be reduced to allow easier transport (i.e., in boxes and shipping containers) and movement (i.e., through small doorways and spaces) of the sofa.

The first aim of the second embodiment (shown in FIGS. 3-11) can be realized via the following technical solution: a foldable frame 299, characterized in that it comprises a frame body 300. The frame body 300 comprises a chassis 301, first support rod 302 and second support rod 303. The chassis 301 is equipped with a base rod 311. The first support rod 302 and second support rod 303 are connected by a connecting structure 400 on each side. The base rod 311, first support rod 302 and second support rod 303 are hinged with the connecting structure 400. The first support rod 302, second support rod 303, connecting structure 400 and base rod 311 form a parallelogram structure on each side. When the first support rod 302 is pushed to fold up the frame body 300, the second support rod 303 is positioned underneath the first support rod 302. When the first support rod 302 is pulled to unfold the frame body 300, the second support rod 303 is parallel with the first support rod 302.

The embodiment shown in FIGS. 3-11 uses the following working principles: the frame body 300 comprises a chassis 301, first support rod 302 and second support rod 303, all of which are appropriately configured. The chassis 301 is used to support the base rod 111, and the first and second support rods 302 and 303 are used to support the cushions on which a user can sit or lie. When the frame body 300 is unfolded, the first support rod 302 is parallel with the second support rod 303, and the user can lie on the cushions. When the frame body 300 is folded, the second support rod 303 is tucked underneath the first support rod 302, meaning that the cushion above the second support rod 303 is stored underneath the cushion above the first support rod 302, allowing the user to sit on the cushion above the first support rod 302. This alternative embodiment uses a parallelogram structure consisting of a base rod 311, first support rod 302 and second support rod 303 that are hinged with the connecting structure 400, allowing the frame 300 to be unfolded and folded up. After placing the cushions on the frame 300, it can be used as a seat or bed depending on the user's requirements.

Preferably, the connecting structure 400 comprises a first connecting rod 401, second connecting rod 402, third connecting rod 403 and fourth connecting rod 404. The two ends of the first connecting rod 401 are hinged with the base rod 311 and second connecting rod 402, respectively. The two ends of the second connecting rod 402 are hinged with the first connecting rod 401 and third connecting rod 403, respectively. The center of the second connecting rod 402 is hinged with the fourth connecting rod 404, and the two ends of the third connecting rod 403 are hinged with the second connecting rod 402 and first support rod 302, respectively. The two ends of the fourth connecting rod 404 are hinged with the chassis 301 and the first support rod 302, respectively.

Preferably, one end of the base rod 311 is hinged onto the fourth connecting rod 404. The other end of the base rod 311 is equipped with a sliding piece 414. The chassis 301 is equipped with a sliding rail 321. The sliding piece 414 is configured to move (i.e., slide back and forth) along the length of the sliding rail 321.

Preferably, the chassis 301 is equipped with an extension. The sliding rail 321 is positioned at the rear end of the extension, and the fourth connecting rod 404 is hinged with the front end of the extension.

Preferably, both the first connecting rod 401 and fourth connecting rod 404 are equipped with an extension rod 500. The end of the extension rod 500 of the first connecting rod 401 is hinged with the second support rod 303, while the end of the extension rod 297 of the fourth connecting rod 404 is hinged with the second connection rod 402.

Preferably, the frame body 300 comprises a support frame 304 and a slideway 305. The ends of the second support rods 303 are hinged with the front end of the support frame 304 on each side. The rear end of the support frame 304 is equipped with rollers 314 that are configured to ride in and move along the slideway 305.

The second aim of the embodiment shown in FIGS. 3-11 can be realized via the following technical solution: a seat, characterized in that it comprises the aforementioned frame 300 and a seat frame 600. The chassis 301 is secured to the seat frame 600.

Preferably, the seat includes a first cushion 700 positioned above the first support rod 302, a second cushion 800 positioned above the second support rod 303, and a third cushion 900 positioned above the support frame 304.

Preferably, the base of the first cushion 700 is equipped with a first support plate 701. The first support plate 701 is equipped with a support stand 711 to support the seat on the floor. The base of the second cushion 800 is equipped with a second support plate 801. The third cushion 900 is directly placed on the support frame 304. When pushing or pulling the first support rod 302, the third cushion 900 is preferably removed, and the cushion is placed on the support frame 304 after the frame body 300 is fully expanded or folded.

Preferably, the first support plate 701 is connected to the first support rod 302, and the second support plate 801 is connected to the second support rod 303.

Compared with other existing technologies, the embodiment shown in FIGS. 3-11 offers the following advantages:

The second embodiment uses a parallelogram structure consisting of a base rod 311, first support rod 302 and second support rod 402 that are hinged with the connecting structure 400, allowing the frame to be unfolded and folded. After placing the cushions on the frame, it can be used as a seat or bed depending on the user's requirements. The support frame 304 is slidable up and down along the slideway 305, and the slideway 305 can be folded along a hinge 910 (if provided) as shown in FIG. 8.

Figure 9:
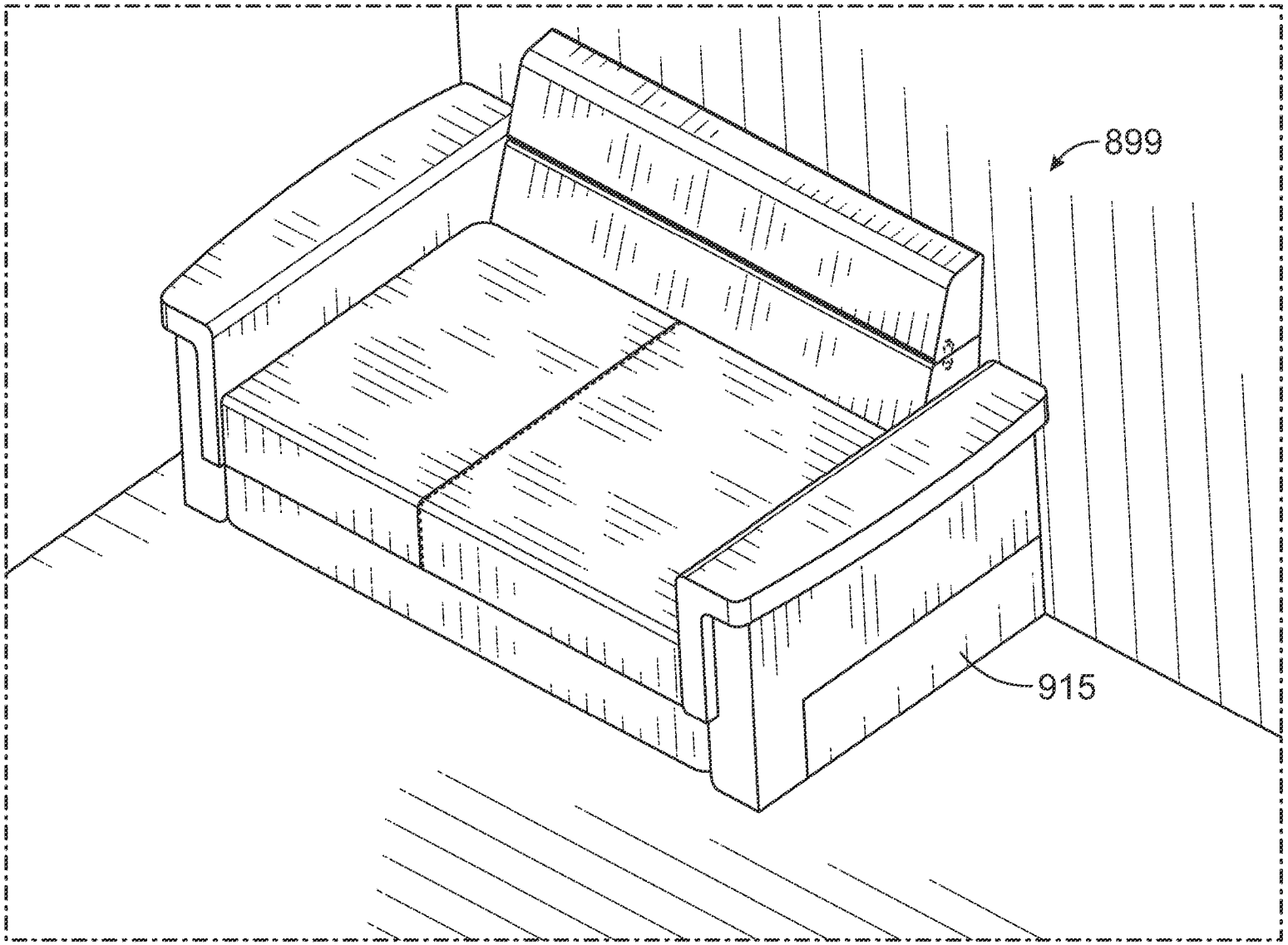
FIG. 9 is a perspective view of the alternative embodiment sofa, showing the sofa disposed on a moveable platform, such as in a recreational vehicle.
Figure 10:
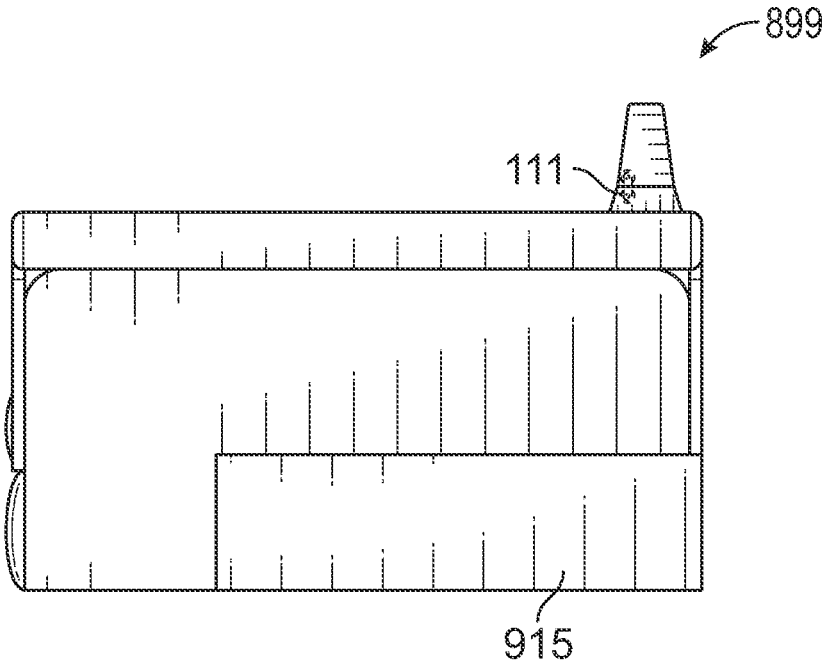
FIG. 10 is a side view of the sofa of FIG. 9.
Figure 11:
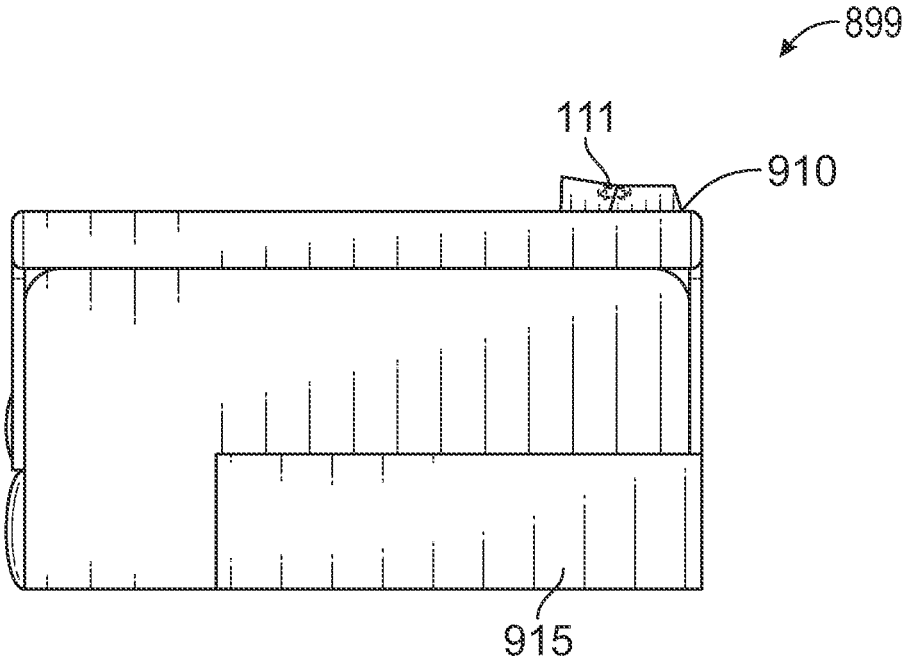
FIG. 11 is a side view of the sofa from FIG. 10 with the head folded down.

As shown in FIGS. 9-11, the sofa 899 in which is the foldable frame 299 is disposed may have a space or notch 898 underneath (see FIGS. 7 and 8) that is configured to be fastened or otherwise affixed to a platform 915 (see FIGS. 9-11), wherein the platform is moveable such as in a slide out of a recreational vehicle, to effectively move the sofa laterally. It is also contemplated that the notch 898 may also be incorporated into the outer arms 101 of the sofa 100 to allow the sofa 100 to accommodate a slide out of a recreational vehicle just as the sofa 899. The progression from FIG. 10 to FIG. 11 also illustrates the folding of the slideway 305 of the frame 299, as discussed above with regard to FIG. 8. As shown, this provides that the sofa has a lower profile with regard to overall height. This is advantageous such that the lower profile is easier to sit in and get up from. Additionally, the lower profile can reduce the risk of a fall by a user leaving the sleeper in the dark from an awkwardly raised position about the floor of the recreational vehicle. As shown in FIGS. 9-11, the sofa 899 may also include one or more hinges 111 for folding the back of the sofa, much like the first embodiment described previously. In some embodiments, the top portion 109 may have inverted trays or cup holders that are exposed for use when the top portion 109 is inverted by folding it with hinge 111.

It should be understood that the term hingedly or hinge, as used herein, comprises the use other suitable fasteners, as will be readily understood by those of skill in the art.

It should be understood that the notch 898 is suitable for incorporation in sofa 100 for the same purpose as that described for the sofa depicted in the second embodiment, i.e., FIG. 7-11. Similarly, the fold-down back support 105 with hinge 111 shown in FIGS. 1A and 9 may be used on the back cushion of FIGS. 7 and 8.

Further, a seat armrest is installed on the seat frame 600 to facilitate the user to rest; preferably, an installation groove is provided on the seat armrest to facilitate the connection and fixation of the seat with other components, such as a motorhome. The opening position is not limited and can be opened according to needs; in this embodiment, the installation groove is 7 inches high; in other embodiments, the installation groove can also be opened according to the required size.

Preferably, the seat back can be flipped forward and folded so that the seat can pass through the narrow caravan door; the seat back refers to the upper part of the rightmost strut of the seat frame 600 in FIG. 6, and the upper part is at least partially connected to the lower part. It is preferably a split structure, and the upper part and the lower part are rotationally connected, preferably via a hinge connection (see 910 in FIG. 8), so that the upper part can be turned to the left, folding and storing, reducing the volume, so as to facilitate passing through the narrow door of a recreational vehicle.

While embodiments in the present disclosure have been described in some detail, according to the preferred embodiments illustrated above, it is not meant to be limiting to modifications such as would be obvious to those skilled in the art.

The foregoing disclosure and description of the disclosure are illustrative and explanatory thereof, and various changes in the details of the illustrated apparatus and system, and the construction and the method of operation may be made without departing from the spirit of the disclosure.

What is claimed is:

1. An apparatus for sitting and sleeping, comprising:

a foldable frame configured to transition between a sitting position and a sleeping position, the foldable frame having a frame body comprising a chassis having a first support rod, second support rod, and a support frame, wherein an end of the second support rod is hinged with a front end of the support frame, wherein the foldable frame is slidable along a slideway; and a connecting structure to connect the first support rod and the second support rod, wherein the first support rod and second support rod are hinged with the connecting structure, wherein the first support rod is parallel with the second support rod in the sleeping position, wherein the chassis has a base rod hinged with the connecting structure and wherein the connecting structure comprises a first connecting rod, second connecting rod, third connecting rod, and fourth connecting rod, wherein a first end and a second end of the first connecting rod are hinged with the base rod and second connecting rod, respectively, and wherein a first end and a second end of the second connecting rod are hinged with the first connecting rod and third connecting rod, respectively.

2. The apparatus of claim 1, wherein the first support rod, second support rod, connecting structure and base rod form a parallelogram structure.

3. The apparatus of claim 1, wherein a center of the second connecting rod is hinged with the fourth connecting rod, and a first end and a second end of the third connecting rod are hinged with the second connecting rod and first support rod, respectively.

4. The apparatus of claim 3, wherein a first end and a second end of the fourth connecting rod are hinged with the chassis and the first support rod, respectively.

5. The apparatus of claim 4, wherein one end of the base rod is hinged onto the fourth connecting rod, wherein another end of the base rod comprises a sliding piece, wherein the sliding piece moves along a sliding rail.

6. The apparatus of claim 5, wherein the chassis comprises an extension, wherein the sliding rail is located at a rear end of the extension, and the fourth connecting rod is hinged with a front end of the extension.

7. The apparatus of claim 6, wherein the first connecting rod and fourth connecting rod are both equipped with an extension rod, wherein an end of the extension rod is hinged with the second support rod.

8. The apparatus of claim 1, wherein the frame body comprises the slideway, wherein an end of the second support rod is hinged with a front end of the support frame, wherein a rear end of the support frame comprises a roller that moves along the slideway.

9. The apparatus of claim 8, further comprising a seat, wherein the seat comprises a seat frame and the foldable frame, wherein the chassis is secured to the seat frame.

10. The apparatus of claim 9, wherein the seat further comprises a third cushion positioned above the support frame.

11. The apparatus of claim 10, wherein the base of the first cushion is equipped with a first support plate, the first support plate is equipped with a support stand to support the seat on the floor, wherein the base of the second cushion is equipped with a second support plate.

12. The apparatus of claim 11, wherein the first support plate is connected to the first support rod and the second support plate is connected to the second support rod.

13. The apparatus of claim 1, further comprising a pair of outer arms that define a notch configured to receive a raised section of a floor to support the apparatus.

14. The apparatus of claim 1, wherein the support frame is configured to be at an incline ranging from 0 to 15 degrees in the sleeping configuration.

15. The apparatus of claim 8, wherein the slideway comprises a J-shaped track configuration to engage the roller of the support frame.

16. The apparatus of claim 8, wherein the movement of the roller of the support frame transitions the frame between the sitting position and the sleeping position.

17. The apparatus of claim 9, further comprising a seat armrest coupled with the seat frame.

18. The apparatus of claim 1, further comprising a first cushion positioned above the first support rod; a second cushion positioned above the second support rod, wherein the first cushion is positioned above the second cushion and the second support rod in the sitting position; and a third cushion configured to be placed on the support frame, wherein second support rod is positioned underneath the first support rod in the sitting position.

19. An apparatus for sitting and sleeping, comprising:

a foldable frame having a frame body comprising a chassis having a base rod, first support rod, second support rod, wherein the foldable frame is foldable along at least one hinge, the frame being configured to transition between a sitting position and a sleeping position, wherein second support rod is positioned underneath the first support rod in the sitting position and wherein the first support rod is parallel with the second support rod in the sleeping position; and a connecting structure to connect the first support rod and the second support rod, wherein the base rod, first support rod, and second support rod are hinged with the connecting structure, the connecting structure comprising a first connecting rod, second connecting rod, third connecting rod, and fourth connecting rod, wherein a first end and a second end of the first connecting rod are hinged with the base rod and second connecting rod, respectively, wherein a first end and a second end of the second connecting rod are hinged with the first connecting rod and third connecting rod, wherein a center of the second connecting rod is hinged with the fourth connecting rod, and a first end and a second end of the third connecting rod are hinged with the second connecting rod and first support rod.

20. The apparatus of claim 19, wherein the first support rod, second support rod, connecting structure and base rod form a parallelogram structure.

* * * * *